US006051939A

United States Patent [19]

Eckert

[11] Patent Number: 6,051,939

[45] Date of Patent: Apr. 18, 2000

[54] METHOD AND APPARATUS FOR CONTROLLING THE POWER OF A HIGH-PRESSURE GAS-DISCHARGE LAMP

[75] Inventor: Klaus Eckert, Durbach Ebersweier, Germany

[73] Assignee: Robert Bosch GmbH, Stuttgart, Germany

[21] Appl. No.: 08/983,048

[22] PCT Filed: Jun. 7, 1996

[86] PCT No.: PCT/DE96/01000

§ 371 Date: Jan. 15, 1998

§ 102(e) Date: Jan. 15, 1998

[87] PCT Pub. No.: WO97/12498

PCT Pub. Date: Apr. 3, 1997

[30] Foreign Application Priority Data

Sep. 26, 1995 [DE] Germany ..... 195 35 663

[51] Int. Cl.[7] ..... G05F 1/00

[52] U.S. Cl. ..... 315/307; 315/224; 315/308; 315/291

[58] Field of Search ..... 315/308, 224, 315/307, 291, 219, 128, DIG. 7

[56] References Cited

U.S. PATENT DOCUMENTS 4,240,009 12/1980 Paul ..... 315/224

5,051,660 9/1991 Domann et al. ..... 315/219

5,481,163 1/1996 Nakamura et al. ..... 315/308

FOREIGN PATENT DOCUMENTS

WO8801468 2/1988 WIPO .

OTHER PUBLICATIONS

"System Specifications for Field Test" of the Vedilis Eureka Prject 273, p. B 1/3.

*Primary Examiner*—Haissa Philogene

*Attorney, Agent, or Firm*—Venable; George H. Spencer

[57] ABSTRACT

A method of controlling the power of a high-pressure gas discharge lamp (1), in which a control device is provided that controls a provided power-supply circuit at an essentially constant power in accordance with a characteristic curve (21), provides purposeful displacement of an operating point along the voltage/current characteristic curve, particularly through the manipulation of one or a plurality of input values of the characteristic curve, for changing the power. An arrangement for executing this method provides that a microcontroller (2) that is part of the control circuit, a control element and software support for the displacement along the characteristic curve (21). The displacement is effected through addition or subtraction of corresponding step values (ΔU) or continuously-changeable values to or from the control values ($U_1$, $U_2$), which are supplied to the control element (3). A further embodiment option for the method consists of using an ASIC in the hardware-supported displacement of the characteristic curve.

11 Claims, 3 Drawing Sheets

METHOD AND APPARATUS FOR CONTROLLING THE POWER OF A HIGH-PRESSURE GAS-DISCHARGE LAMP

BACKGROUND OF THE INVENTION

The invention is based on a method for controlling the power of a high-pressure gas discharge lamp to claim 1.

U.S. Pat. No. 4,240,009 discloses a circuit for operating a gas-discharge lamp that uses a characteristic curve to determine the power supplied to the lamp. The control device includes a power-supply circuit. This circuit is controlled and regulated by means of the voltage/current characteristic curve, so that the lamp is maintained at a specific, particularly constant, power during operation. In this known circuit, the power is determined with a wattmeter, which uses applied voltage and flowing current to determine the power supplied to a regulated inverter circuit by a battery, and from the power, generates control signals for the inverter circuit corresponding to the predetermined voltage/current characteristic curve. If constant power is maintained for the lamp, the respective operating point lies on the so-called power hyperbola.

To provide control during startup and during operation of a high-pressure gas discharge lamp, the Vedilis curve is generally predetermined as a current/voltage curve in the sense of a nominal-value curve. The Vedilis curve is represented in the "System Specifications for Field Test" of the VEDILIS Eureka Project 273, p. B 1/3, and predetermined as a current/voltage characteristic curve for gas discharge lamps to be used in motor vehicles. "Vedilis" is an acronym for "Vehicle Discharge Light System." Accordingly, to regulate the lamp power of a gas discharge lamp, the lamp voltage U is measured during the startup or burning phase, for example, and the corresponding lamp current I associated with the respective lamp voltage U is determined from the Vedilis curve. This lamp current I then serves as a nominal value for the current-regulating circuit with which the lamp power is regulated at a constant value, for example 35 W.

In general, for using a gas discharge lamp in a motor-vehicle headlight, it is necessary to make available as much light as possible within a short time after the control device has been initiated. This is referred to as rapid light startup. As the aforementioned Vedilis curve indicates, the gas discharge lamp can be operated at a certain overload immediately after being turned on. This overload is then reduced after a certain voltage has been attained, as a function of the lamp voltage. This reduction occurs along the hyperbolic portion of the characteristic curve. It is clear that this type of overload must not be allowed to destroy the lamp or negatively affect its service life. This requirement exists for all operating conditions. Furthermore, the control is to be selected such that the light power does not drop back below a value that has already been attained, because this is generally perceived as annoying flickering. This drop in light power is also called light saddle.

SUMMARY OF THE INVENTION

In contrast, the method of the invention for controlling the power of a high-pressure gas discharge lamp, has the advantage of creating an effective change in lamp power that can be executed with simple means and therefore at low cost. It offers the option of covering the entire range of change in power with the use of only one characteristic curve.

The above is achieved by the invention in a method of controlling the power of a high-pressure gas discharge lamp including the steps of controlling a provided power supply circuit at an essentially constant power in accordance with a voltage/current characteristic curve via a control circuit, displacing an operating point on the voltage/current characteristic curve to another point on the curve to change the power of the gas discharge lamp; and changing the power through the manipulation of one or a plurality of input values of the voltage/current characteristic curve wherein the operating point on the voltage/current characteristic curve is purposefullly displaced when the power is changed. Software or hardware can be used in embodiments according to the invention. An apparatus for executing the above method is contemplated which concludes a microcontroller that is part of the control circuit, a control element and software support that effects the displacement of the voltage/current characteristic curve through one of addition and subtraction of corresponding step values or continuously-changeable values to or from control values which are supplied to the control elements.

In accordance with the invention, for changing the power, the voltage/current characteristic curve is purposefully displaced, particularly through the manipulation of one or a plurality of input values of the characteristic curve.

An advantageous embodiment of the invention provides that the characteristic curve is displaced along the voltage axis or the current axis, or simultaneously along both axes. The displacement is advantageously effected in the hyperbolic region of the characteristic curve, with the curve particularly being a so-called Vedilis characteristic curve.

In a particularly useful embodiment of the invention that is distinguished by great flexibility, adaptability and low cost, the characteristic curve is displaced using software support with the aid of a provided microcontroller. In an advantageous and useful modification, the characteristic curve is displaced through addition or substraction of step values or continuously-changeable values, with the step values or continuously-changeable values being dependent on the magnitude of the desired change in power.

Corresponding to a particularly advantageous and useful embodiment of the invention, which avoids the storage of different power hyperbolas, and thus saves storage space or calculation time; the change in power is effected through the displacement of a characteristic curve with only a single provided, particularly stored, characteristic curve. This also avoids flickering of the light that would result during changing from one power hyperbola to the other, because a continuous, rather than an abrupt, transition is present.

A particularly advantageous and useful embodiment of an arrangement for executing the method of the invention is characterized in that a microcontroller is provided in the control circuit, and that the characteristic curve is displaced with software support, particularly through addition or subtraction of corresponding step values or continuously-changeable values to or from the control values, which are supplied to a provided control element.

An alternative, advantageous embodiment of an arrangement for executing the method of the invention includes the provision of an ASIC (Application-Specific Integrated Circuit) in the control circuit, which is used in hardware-supported displacement of the characteristic curve, particularly through addition or subtraction of corresponding step values or continuously-changeable values to or from the control values, which are supplied to a provided control element.

BRIEF DESCRIPTION OF THE DRAWINGS

The invention is described in detail in the following description by way of an embodiment that is illustrated in the drawings in which.

DETAILED DESCRIPTION OF THE PREFERRED EMBODIMENT

Figure 1:
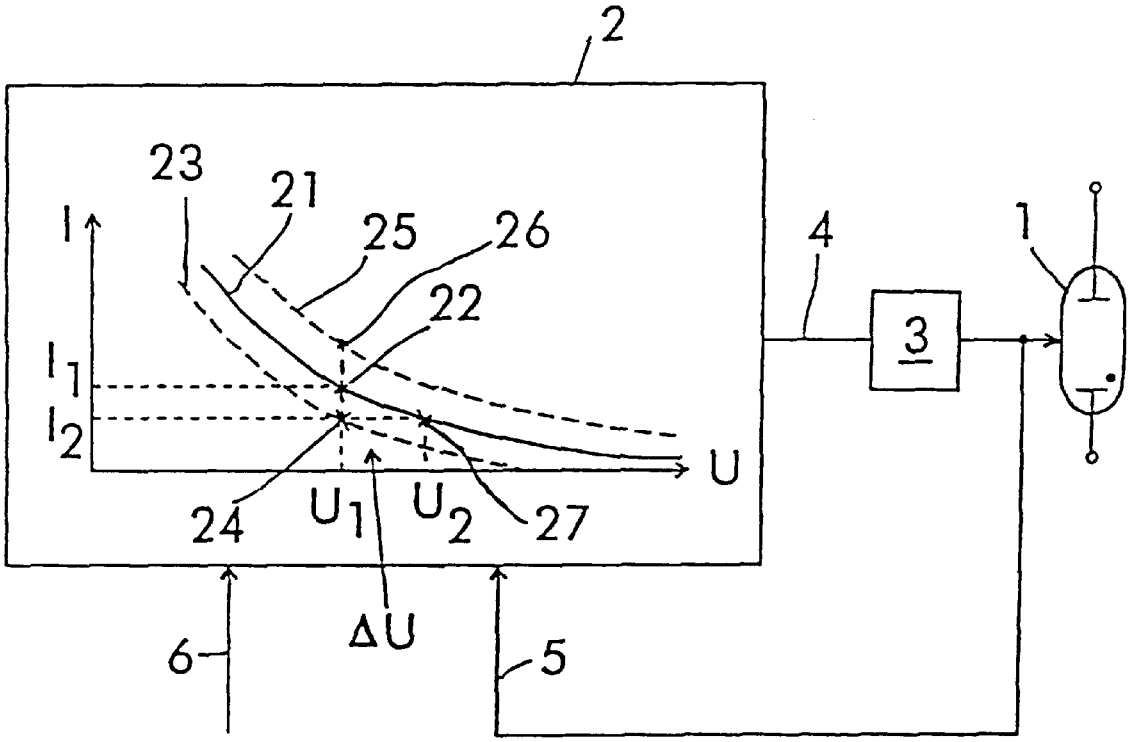
FIG. 1 schematically shows the procedure of the method of the invention for controlling the power of a high-pressure gas discharge lamp.
Figure 2A:
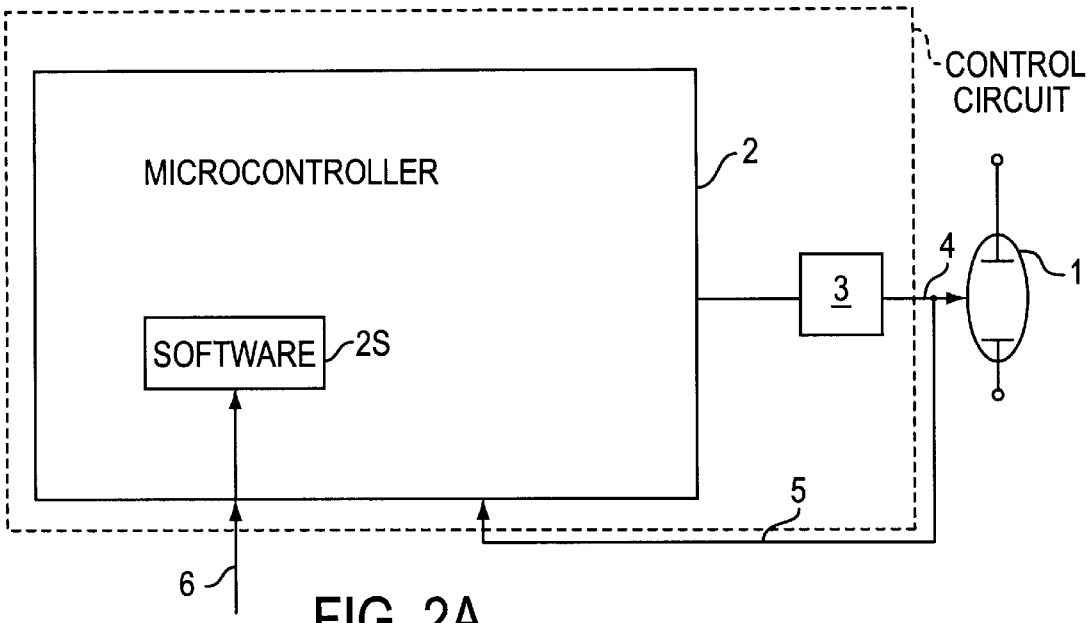
FIG. 2*a* is a schematic illustration of a software supported embodiment according to the invention.
Figure 2D:
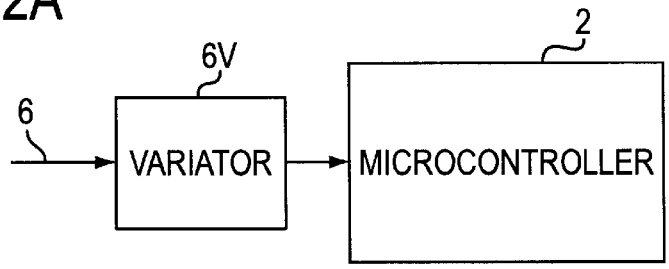
FIGS. 2*b*–2*d* respectively show in schematic form means for displacement along the characteristic curve through addition, subtraction and continuously-changeable values to a provided control value.

FIG. 1 schematically shows the procedure of the method of the invention for controlling the power of a high-pressure gas discharge lamp 1. A control circuit, shown in more detail in FIG. 2*a*, includes a microcontroller 2. The microcontroller transmits a nominal or control value 4 to a control element 3, which value serves to control the power supplied to the high-pressure gas discharge lamp 1. A voltage value 5 corresponding to the voltage or a comparable value measured at the lamp 1 is supplied to the microcontroller 2. A regulating circuit, for example for the current, can be in cascade control with the control element 3. Moreover, a value 6 is supplied to the microcontroller 2, as illustrated, or the microcontroller itself generates a corresponding value. This value 6 represents the change in power according to the invention that is effected by a purposeful displacement of the characteristic curve. This is effected particularly by the manipulation of one or a plurality of input values of the characteristic curve.

To promote better understanding of the invention, the hyperbolic portion of the diagram of a so-called Vedilis characteristic curve 21 is shown schematically in the block representing the microcontroller 2 in FIG. 1. This is a voltage/current characteristic curve in accordance with which the current I is determined as a nominal or control value, for example, with the presetting of the voltage U. It is assumed that the lamp 1 is operated in an operating point 22. A voltage $U_1$ arises with an impressed current $I_1$ at this operating point 22. The power is now to be reduced. To this end, the corresponding information enters the microcontroller 2 as the value 6, or the microcontroller itself generates the corresponding information. The microcontroller 2 then increases the voltage value $U_1$, which corresponds to the applied power, by the change quantity $\Delta U$ to the value $U_2$, which corresponds to the point 27. Then the microcontroller 2 determines the current value $I_2$ corresponding to this voltage value $U_2$ from the characteristic curve 21, and supplies it, as a new nominal or control value 4, to the control element 3. The lamp 1 accordingly receives a lower power, which corresponds to this current $I_2$ and the voltage $U_1$, which actually is approximately still present. Consequently, the voltage also changes somewhat, depending on the lamp. The power hyperbola or characteristic curve 23 that includes the operating point 24 and is shown as a dashed line corresponds to this lower power. The process is reversed for purposefully increasing power; in this instance, the characteristic curve 25 applies, which includes an operating point 26 and is shown as a dashed line.

The change in power according to the invention and described above in connection with the displacement of the characteristic curve 21 along the voltage axis U can be effected analogously along the current axis I. Depending on the type of characteristic curve, and the type and magnitude of the desired change in power, the most-suitable direction or a combination of the two displacement methods can be selected.

Figure 2B:
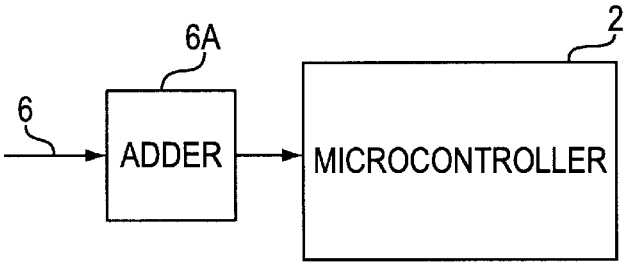
Figure 2C:
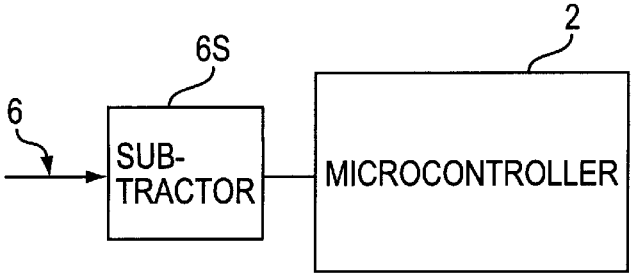
Figure 3:
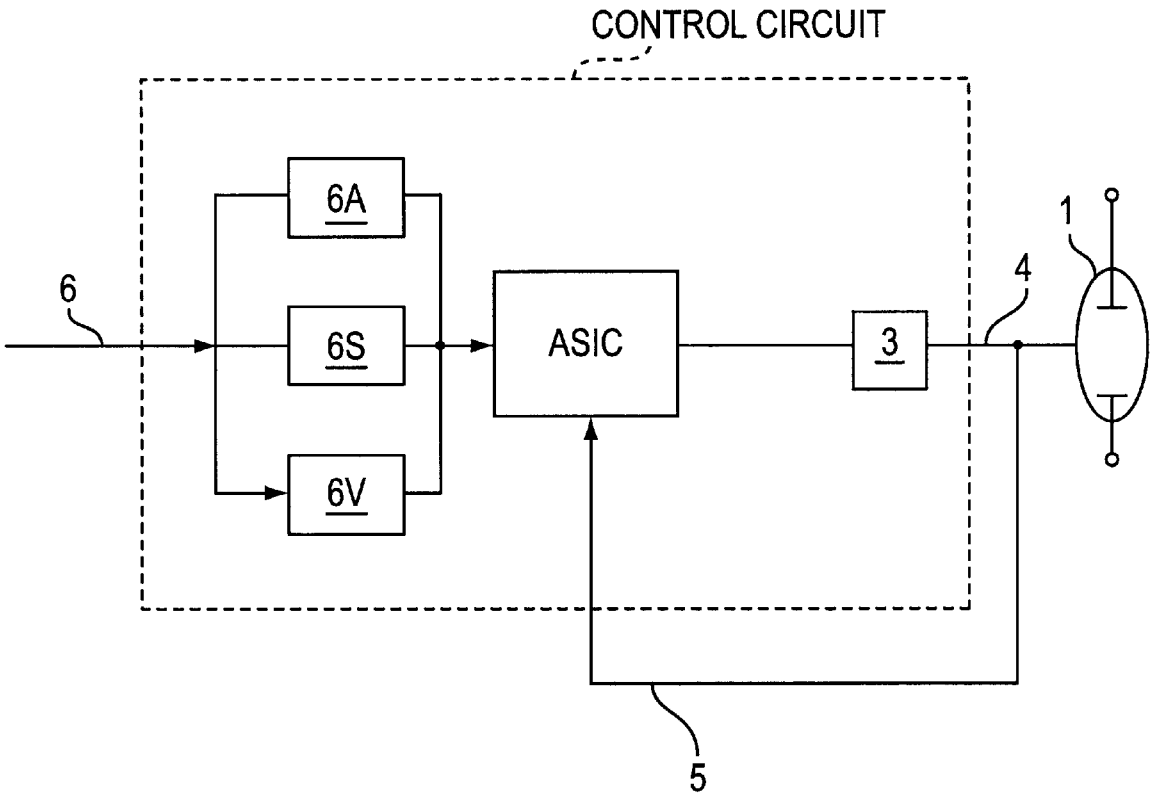
FIG. 3 shows a hardware-supported embodiment according to the invention in schematic form.

According to the illustrated embodiment, the displacement is particularly flexible and practical if a microcontroller is provided in the control device or circuit. Then software 2*s* is used to effect the displacement. As mentioned above, a certain step value corresponding to the desired change in power is added to via an adder 6A or subtracted via a subtractor 6S from the voltage or current value that is actually present. An addition or subtraction of steps is effected particularly simply with software support in a microcontroller as schematically shown in FIGS. 2*b*, 2*c* and 3. This type of displacement also permits only a single characteristic curve to be stored in the memory of the microcontroller. This saves memory space. Depending on the configuration, considerable calculation time can also be saved, particularly if the associated, other value for the lamp must be determined through calculation for each characteristic-curve input value determined at the lamp.

The present method of the invention is an outstanding foundation for an ASIC realization of the microcontroller functions and, possibly, for a hardware-based realization of the Vedilis characteristic curve.

An alternative, advantageous embodiment of an arrangement for executing the method of the invention is illustrated in FIG. 3 and includes the provision of an ASIC, an Application-Specific Integrated Circuit, in the control circuit, and hardware-supported displacement of the characteristic curve, particularly through addition (6A) or subtraction (6S) of corresponding step values or continuously-changeable values via a variator 6V to or from the control values that are supplied to a provided control element.

Thus, the power supplied to the high-pressure gas discharge lamp can be changed with little effort and a low outlay. The power need not be calculated during the running time; neither an analog nor a digital calculation circuit is necessary.

What is claimed is:

1. A method of controlling the power of a high-pressure gas discharge lamp comprising the steps of:

controlling a provided power-supply circuit at an essentially constant power in accordance with a voltage/current characteristic curve via a control circuit; and displacing an operating point along the voltage/current characteristic curve to change the power of the gas discharge lamp, wherein the operating point on the voltage/current characteristic curve is purposefully displaced by manipulating at least one input value of the voltage/current characteristic curve.

2. The method according to claim 1, wherein the operating point on the characteristic curve is displaced along one of the voltage axis and the current axis.

3. The method according to claim 2, wherein the operating point is displaced simultaneously along both axes.

4. The method according to claim 1, wherein the displacement is effected in the hyperbolic region of the characteristic curve, said characteristic curve being a so-called Vedilis characteristic curve.

5. The method according to claim 1, wherein the displacement is effected using software support with the aid of a provided microcontroller.

6. The method according to claim 1, wherein the operating point is displaced through one of addition and step values, said step values being dependent on the magnitude of the desired change in power.

7. The method according to claim, 1 wherein the operating point is displaced through continuously-changeable values, said continuously-changeable values being dependent on the magnitude of the desired change in power.

8. The method according to claim 1, wherein the change in power is effected by the displacement along the characteristic curve, and said curve is a single, stored characteristic curve.

9. An apparatus for executing the method according to claim 9, comprising:

a microcontroller that is part of the control circuit;

a control element connected to the microcontroller for receiving control values; and software support that effects the displacement of the operating point along the characteristic curve.

10. The apparatus according to claim 9, wherein hardware of the software support is one of an adder, a subtracter and a variator which respectively, add step values, subtract step values or continuously change values to or from the control values supplied to the control element.

11. The method according to claim 10, further comprising an ASIC (Application-Specific Integrated Circuit) in the control circuit, said ASIC being used in the hardware-supported displacement of the operating point along the characteristic curve.

* * * * *